United States Patent [19]

Weiland et al.

[11] Patent Number: 4,553,947

[45] Date of Patent: Nov. 19, 1985

[54] SHIFTING MECHANISM FOR MOTORIZED TOY

[75] Inventors: Herbert Weiland, San Pedro; Michael Nuttall, So. Pasadena, both of Calif.; Michihiro Kozuka, Tokyo, Japan

[73] Assignee: Tomy Kogyo Corporation, Inc., Japan

[21] Appl. No.: 601,006

[22] Filed: Apr. 16, 1984

[30] Foreign Application Priority Data

Apr. 25, 1983 [JP] Japan ..... 58-61887[U]

[51] Int. Cl.[4] ..... A63H 29/00; A63H 29/24

[52] U.S. Cl. ..... 446/443; 446/463; 446/469

[58] Field of Search ..... 446/443, 457, 462, 463, 446/466, 469

[56] References Cited

U.S. PATENT DOCUMENTS

| | | | |
|---|---|---|---|
| 3,786,597 | 1/1974 | Sano | 446/443 |
| 4,152,866 | 5/1979 | Suda | 446/463 |
| 4,459,776 | 7/1984 | Jaworski et al. | 446/469 X |
| 4,467,557 | 8/1984 | Kuna et al. | 446/463 |
| 4,509,931 | 4/1985 | Lambert et al. | 446/466 X |
| 4,511,343 | 4/1985 | Goldfarb et al. | 446/463 |

*Primary Examiner*—Mickey Yu

*Attorney, Agent, or Firm*—K. H. Boswell

[57] ABSTRACT

A shift mechanism for a motorized toy includes a shift lever which is mounted on the toy so as to be able to move back and forth along an X axis and back and forth along a Y axis. The toy includes an electric motor and electric power supply for powering the same. A gear train connects the electric motor to an output shaft. A shift mechanism is connected between the shift lever such that movement of the shift lever along one of the X or Y axes shifts certain of the gears in the gear train to control the speed of the output of the output shaft. Movement along the other of the axes of the shift lever controls an electric switch which governs both the polarity of the current supplied to the motor to provide for both forward and reverse rotation of the output shaft as well as to break the circuit between the power supply in order to start and stop the toy.

18 Claims, 9 Drawing Figures

SHIFTING MECHANISM FOR MOTORIZED TOY

BACKGROUND OF THE INVENTION

This invention is directed to a shifting mechanism for a motorized toy which utilizes movement of a shift lever in a first direction to operate a mechanical control and movement of the shift lever in a second direction to control an electrical control.

A variety of motorized toys are known wherein a small electric motor or the like moves a component of the toy with respect to other components of the toy. These types of toy include wheeled vehicles, walking toys and the like. The simplest of these mechanism would be simply an off and on switch or the like.

Transmissions have been provided in toy wheeled vehicles which render the vehicle capable of travelling at one or more speeds. For the most parts, these prior known mechanisms do not simulate the actual shifting mechanism utilized in actual automobiles. For the most part they require the child to utilize an off/on switch to first activate the motor and then utilize some sort of shifting or selecting mechanism which in fact does not operate in the same manner as their counterpart in actual automobiles.

BRIEF DESCRIPTION OF THE INVENTION

In view of the above, it is a broad object of this invention to provide a shifting mechanism which controls the drive motor of a toy vehicle wherein the shifting mechanism operates in much the same manner as the mechanism for automobile, with the exception that the shifting mechanism is utilized to control an electric motor. Additionally it is an object of this invention to provide a shifting mechanism which, in the illustrative embodiment, can be utilized to provide off/on, forward-/reverse and speed range control of the motorized toy. For instance, in the preferred embodiment, the motorized toy constitutes a wheeled vehicle capable of moving across a support surface at at least two speeds and at least a forward and reverse direction. It is a further object of this invention to provide a shift mechanism which because of its engineering principles is easy and economical to manufacture and is susceptible to a long and useful lifetime.

These and other objects, as will be evident from the remainder of this specification are achieved in a shift mechanism for a motorized toy which comprises: a shift lever movably mounted on said toy so as to move back and forth along an X axis and a Y axis; an electric motor mounted on said toy, said electric motor capable of producing a rotary output in both a clockwise and a counterclockwise direction; an electric power supply connected to said electric motor to power said motor; an output shaft for producing motion of a portion of said toy with respect to a further portion of said toy; a mechanical linkage means connecting to said motor for transferring the output of said motor to said output shaft; an electrical linkage means operatively associated with said motor for controlling the direction of rotation of said electrical motor; an X axis control means for transfer of motion of said shift lever about said X axis to said mechanical linkage means for controlling transfer of said output of said motor to said output shaft; a Y axis control means for transferring motion of said shift lever about said Y axis to said electrical linkage means for controlling at least the direction of output of said motor.

In the illustrative embodiment, the mechanical linkage means includes means such as a gear means which is useful for driving an output shaft at at least two speeds. Further in the illustrative embodiment, the electrical linkage means would include means for controlling the power input to the electric motor so as to control both the direction of rotation of the electric motor and stopping and starting of the electric motor.

It is preferred to supply a clutch means for separating movement of the shift lever about the X and Y axes such that movement about the X axis is isolated from movement of the Y axis. In the illustrative embodiment this is achieved by utilizing a first clutch means for inhibiting transfer of movement from the shift lever about the Y axis to the mechanical linkage and a second clutch means for inhibiting transfer of the movement of the shift lever about the X axis to the electrical linkage means.

For the illustrative embodiment, the electrical linkage means includes an electrical switch capable of reversing the polarity of power supplied to the motor by a power supply and further for breaking or making the electrical circuit between the power supply and the electric motor.

BRIEF DESCRIPTION OF THE DRAWINGS

The invention described in this specification will be better understood when taken in conjunction with the drawings wherein.

This invention utilizes certain principles and/or concepts as are set forth in the claims appended to this specification. Those skilled in the toy arts will realize that these principles and/or concepts are capable of being expressed in a variety of embodiments which may differ from the exact embodiment utilized for illustrative purposes herein. For this reason, this invention is not to be construed as being limited only to the illustrative embodiment, but is only to be construed in view of the claims.

DETAILED DESCRIPTION OF THE INVENTION

Figure 1:
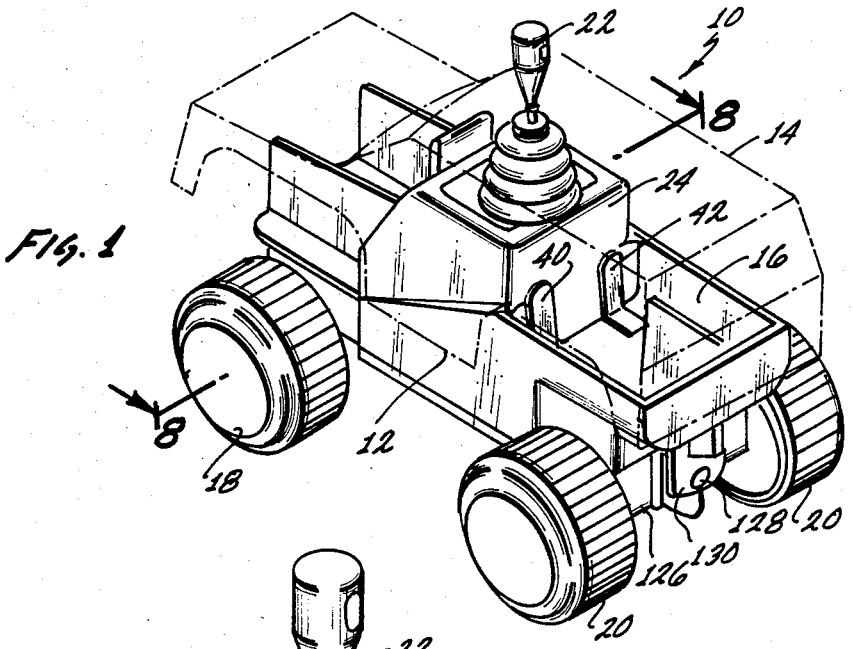
FIG. 1 is an isometric view of a toy wheeled vehicle with the chassis and wheels of the vehicle shown in solid line and the top canopy shown in phantom line.

In FIG. 1 there is shown a toy wheeled vehicle 10 having a chassis 12 and, in phantom lines, a canopy or top 14. The canopy 14 snaps on and off of the chassis 12 for convenient access to a battery compartment 16. The vehicle is supported by front wheels collectively identified by the numeral 18 and back wheels collectively identified by the numeral 20.

Projecting out of the center of the top of the canopy 14 is a shift lever 22. The shift lever 22 moves in a basic "H" pattern, much like a standard four speed transmission shift lever on an automobile. If pushed as viewed in FIG. 1, to the left and forward, the vehicle 10 moves forward at a slow speed. If pushed to the left and pulled to the rear, the vehicle moves forward at a high speed. If pushed to the right and forward, the vehicle moves in reverse direction at a low speed and if pushed to the right and rearward, in the reverse direction at a high speed. When the shift lever 22 is in a center or neutral position as is seen in FIG. 1 the vehicle is at rest and an electrical circuit to an electrical motor hereinafter described, is broken, conserving the power in appropriate batteries not numbered or shown, which are located in the battery case 16.

Figure 2:
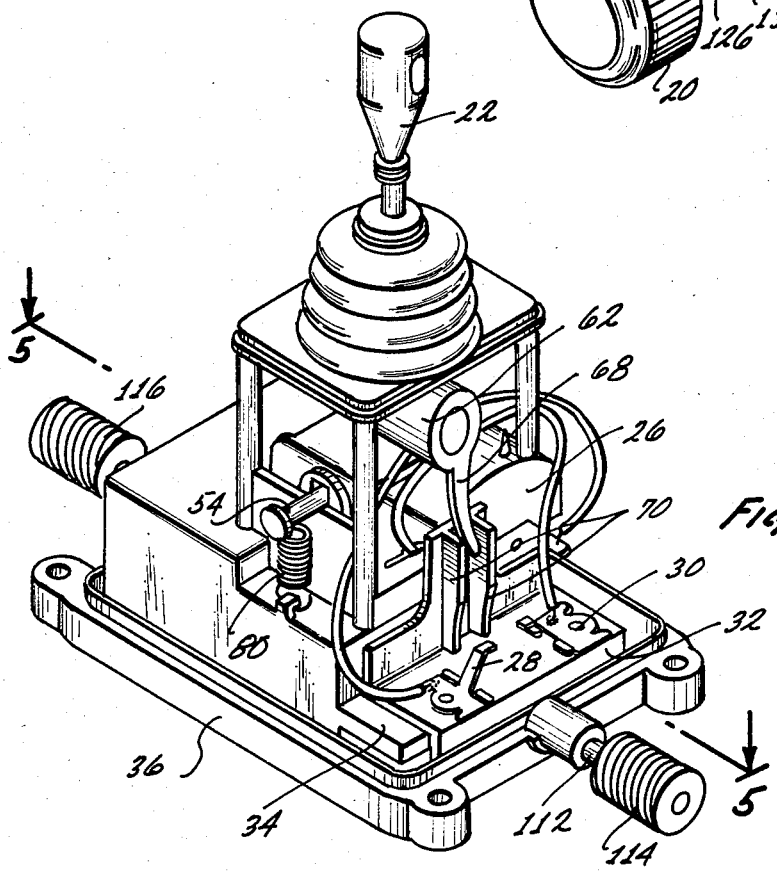
FIG. 2 is an isometric view of certain of the portions of FIG. 1 with overlying housing member removed for clarity of underlying parts.

In FIG. 2 the canopy 14 as well as a housing component 24 have been removed for clarity of underlying parts. The electric motor 26 which for the illustrative embodiment is a DC reversible electric motor, is connected by appropriate lead lines to first electrical pick-up arm 28 and second electrical pick-up arm 30. Both of the pick-up arms 28 and 30 are located on a sliding member 32 which slides from left to right on a shelf 34 formed as a part of housing component 36.

Figure 3:
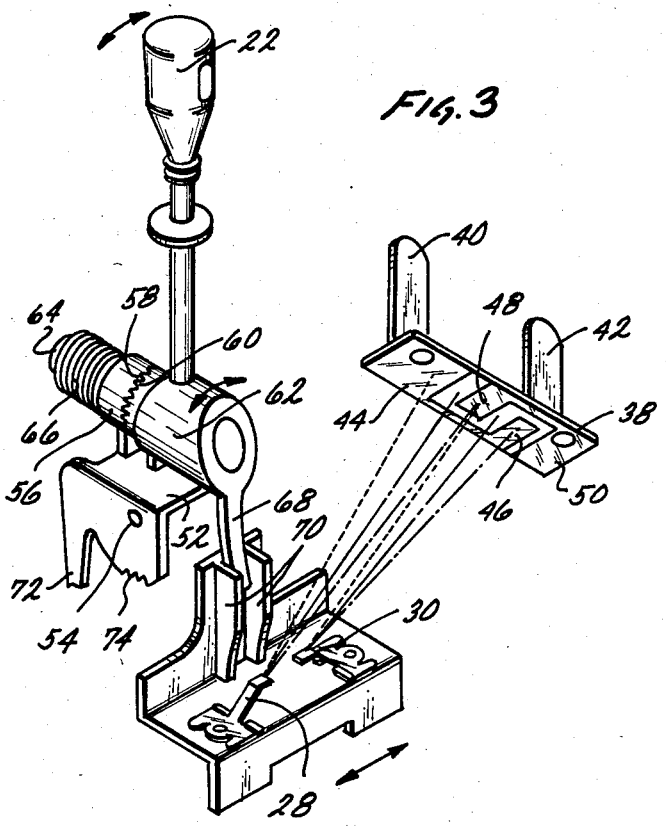
FIG. 3 is a fragmentary isometric exploded view of certain of the components of FIG. 2 plus an additional component not seen in FIG. 2.

In FIG. 3 the bottom side of a contact support member 38 is seen in conjunction with the sliding member 32. Two contact arms 40 and 42 are mounted on the member 38 and project upwardly into the battery case 16. There they make appropriate electrical contact with batteries located in the battery case 16.

The batteries are located in the battery case 16 with an appropriate shunt connecting the positive terminal of one battery to a negative terminal of another battery such that one of the contact arms 40 is connected to ground for the batteries and the other one is connected to positive. On the underside of the contact support member 38 the contact arm 40 has two electrical contact surfaces, area 44 and area 46. Likewise, contact arm 42 has two contact areas, area 48 and area 50. The sliding member 32 slides transversely back and forth, that is from left to right. In a first position, toward the left as seen in FIG. 3, contact arm 28 makes electrical contact with contact area 44 and contact arm 30 makes electrical contact with contact area 48. This completes the circuit between electrical pick-up arm 28 and the contact arm 40 and electrical pick-up arm 30 and the contact arm 42. When the sliding member 32 is slid all the way to the right, the pick-up arm 28 makes contact with the contact 40 connecting it to electrical contact arm 42 and the pick-up arm 30 makes electrical contact with contact area 46 connecting it to electrical contact arm 40. As such, at this time, the polarity of the circuit to the pick-up arms 28 and 30 is reversed to that described in the previous instance. This reverse the polarity to the electric motor 26 to reverse the direction of the motor.

When the sliding member 32 is in a center or neutral position, the pick-up arm 28 rests against the contact support member 38 which is formed of a dielectric material between contact areas 44 and 48, and the pick-up arm 30 rests against the dielectric material of the sliding member 38 between the contact areas 48 and 46. This breaks the circuit between the batteries and the motor 26 to deactivate the motor, and as will be evident from the remainder of this specification, stop all movement of the vehicle 10.

Figure 7:
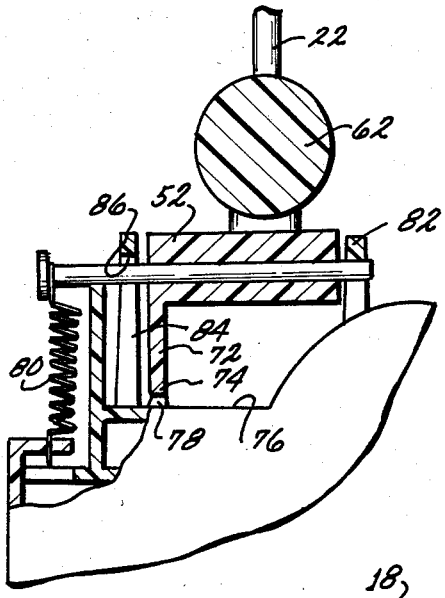
FIG. 7 is an elevational view in section about a portion of the toy located in the central part of FIG. 3.
Figure 8:
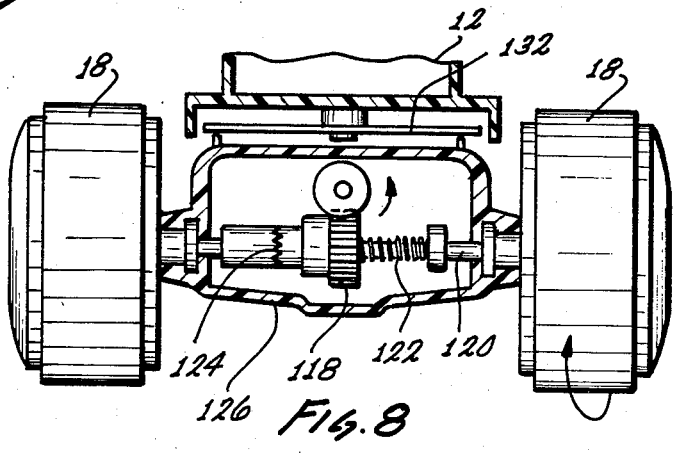
FIG. 8 is an elevation view in partial section about the line 8—8 of FIG. 1.
Figure 9:
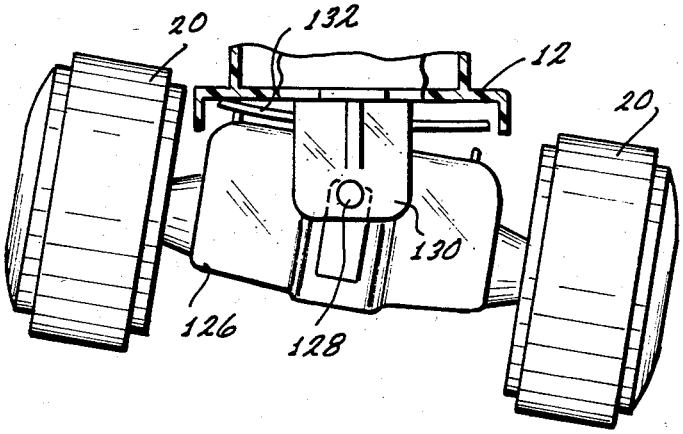
FIG. 9 is a view similar to FIG. 8 showing certain components in a different spatial relationship.

Looking now at FIG. 7, a carrier member 52 is hinged about a pin 54 which is ultimately supported on the chassis 12. This allows the carrier member 52 to rock backward and forward toward and away from the plane of FIG. 7. As hereinafter described, ultimately the shift lever 22 is attached to the carrier member 52. For FIG. 7, movement of the shift lever 22 toward and away from the observer is transmitted to the carrier member 52 allowing it to rock about the pin 54.

Figure 4:
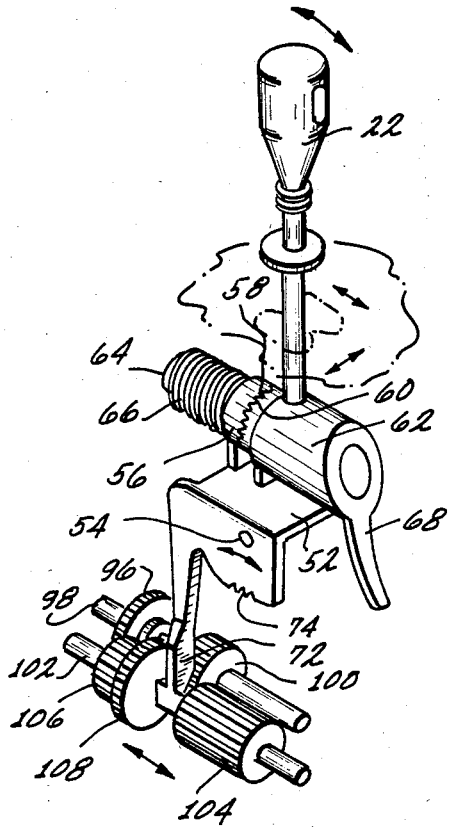
FIG. 4 is a further fragmentary isometric view of certain of the components of FIG. 2 plus additional components which are hidden from view in FIG. 2 by overlying housing members.

As seen in FIGS. 3 and 4, the carrier member 52 has a drum 56 integrally formed with it during manufacture of the drum. The drum 56 includes a set of crown teeth 58 located on its surface. These crown teeth 58 mesh with crown teeth 60 formed on a rotating member 62 to which the shift lever 22 is attached. The rotating member 62 is held against the drum 56 by a screw 64 which passes through a spring 66 and through an opening, not numbered or shown, in the drum 56 until it screws into the rotating member 62. The screw 64 is not connected to the drum 56 but is only connected to the rotating member 62. This forms a rotating connection of the rotating member 62 to the drum 56.

Since the carrier member 52 is hinged to the chassis 12 by the pin 54 it is free to rock back and forth, but is not free to rock side to side. If the shift lever 22 is pushed back and forth in FIG. 4, that is, from the upper left hand corner to the lower right hand corner, this movement will be communicated by the shift lever 22 through the rotating member 62 to the carrier member 52 to rotate it about the pin 54. If the shift lever 22 is rocked back and forth, that is, from the upper right hand corner to the lower right hand corner of the Fig., the rotating member 62 will slip with respect to the drum 56 by compression of the spring 66 with movement of the crown teeth 60 with respect to the crown teeth 58. Thus, left and right movement of the shift lever 22 is not transferred to the carrier member 52.

The rotating member 62 carries a finger 68 thereon which projects downwardly and resides between two webs collectively identified by the numeral 70 which are formed on the sliding member 32. Engagement of the finger 68 with the webs 70 transfers left and right movement of the shift lever 22 to the sliding member 32 to slide it back and forth across the shelf 34 to effect the off and on and change of polarity to the electric motor 26 described above.

The webs 70 are of a sufficient width such that the rotating member 62 and the carrier member 52 can rotate about the pin 54 fore and aft and still maintain engagement of the finger 68 between the webs 70. However, as the finger 68 moves fore and aft with respect to the webs 70 no fore and aft movement of the shift lever 22 is transmitted to the sliding member 32. The movement of the finger 68 with respect to the webs 70 thus provides a first clutch mechanism for inhibiting fore and aft or X axis movement of the shift lever 22 from being transferred to the sliding member 32. It does, however, allow transfer of left to right or Y axis movement of the shift lever 22 to the sliding member 32 to perform the necessary circuit connections described above.

Figure 5:
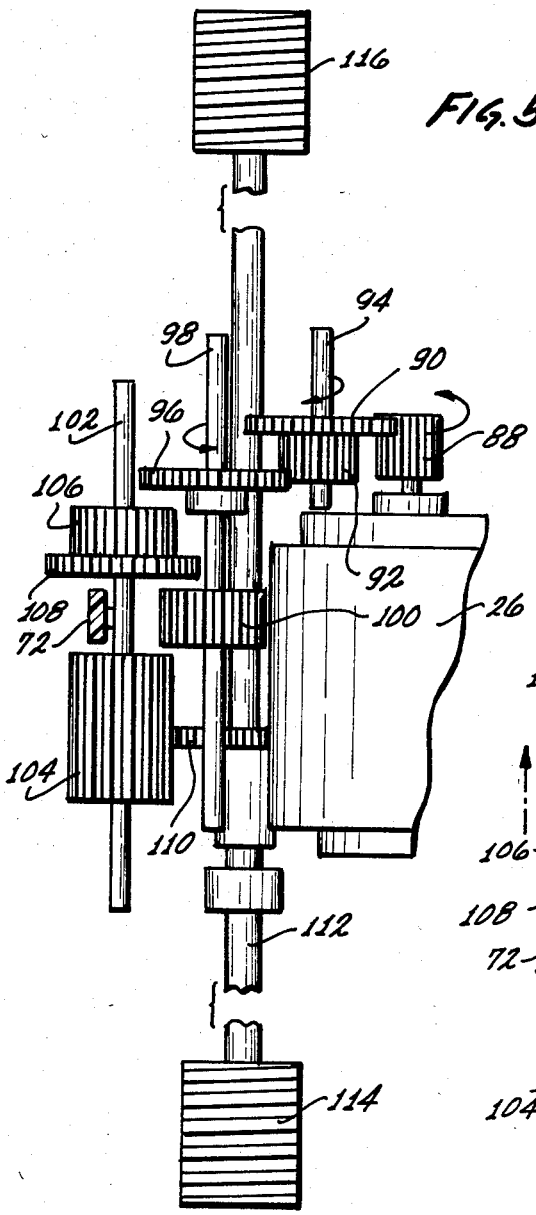
FIG. 5 is a top plan view about the line 5—5 of FIG. 2 with certain of the components in a first spatial relationship.
Figure 6:
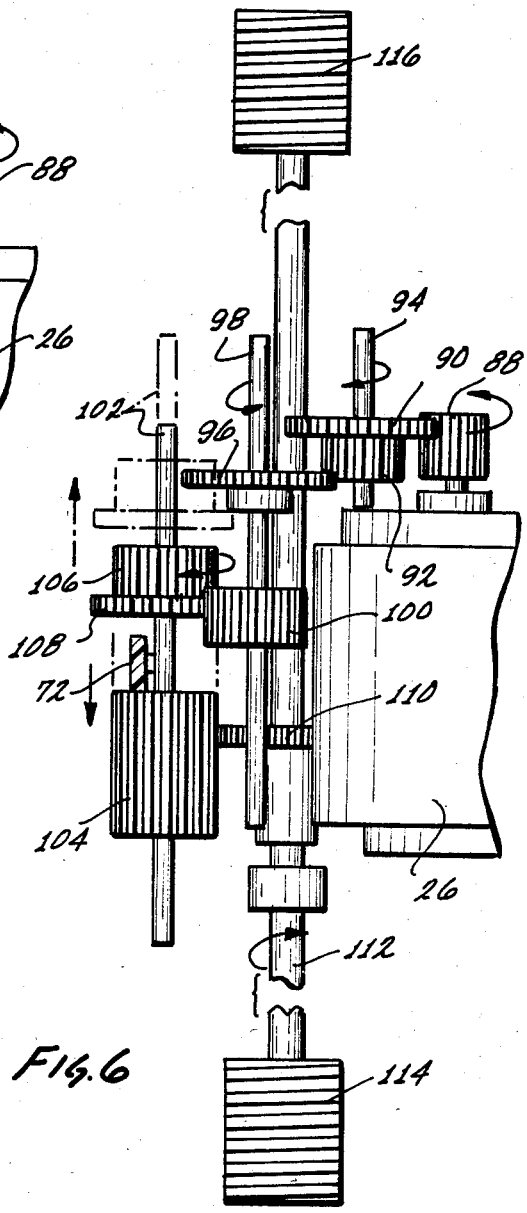
FIG. 6 is a view similar to FIG. 5 with certain components shown in a second spatial relationship in solid line and a third spatial relationship in phantom line.

Extending down from the carrier member 52 is an arm 72. The arm 72 contacts certain gears a hereinafter described shifting them to different relative positions as seen in FIGS. 5 and 6 to change the speeds of travel of the vehicle 10. Also on the carrier member 52 is a small gear sector 74. The gear sector 74 extends down toward surface 76 formed on housing component 36. On the surface 76 is a ridge 78 which interacts with the teeth of the gear 74. As the carrier member 52 is pivoted about the pin 54, the teeth of the gear sector 74 move over the ridge 78. Once movement of the shift lever 22 stops, the teeth engage the ridge to hold the carrier member 52 in the last position it was shifted to by fore and aft movement of the shift lever 22. Thus, if the shift lever 22 is pushed forward, the arm 72 moves backward and the gear sector 74 interacting with the ridge 78 holds it in this position until further moved by the operator of the toy 10.

A spring 80 as seen in FIG. 7 is attached to the pin 54. It is further attached at its other end to the housing component 36. The pin 54 rides in appropriate bearing openings formed in webs 82 and 84. The bearing opening 86 formed in web 84 is an elongated slot which allows some upward and downward movement of the pin 54. Thus, as the gear sector 74 rides along the ridge 78 as each of the individual teeth of the gear sector 74 engage the ridge, the totality of the carrier member 52 and parts connected thereto are raised upwardly, with the pin 54 moving a small increment within the slot 86. The spring 80 is stretched and as soon as the tooth of the gear sector 74 clears the ridge 78, and the ridge 78 is then located in between two adjacent teeth, the spring 80 returns the pin 54 downwardly moving the carrier member 52 downwardly as well as the arm 72 to lock the arm 72 in the next adjacent tooth of the gear sector 74 against the ridge 78.

Looking now at FIGS. 5 and 6, the motor 26 has an output pinion 88 attached thereto. The pinion 88 engages spur gear 90 which is integrally formed with a pinion 92. Both of these are mounted together so as to rotate as an integral unit on the shaft 94. A spur gear 96 fixedly mounted to a shaft 98 is rotated by the pinion 92 and in turn rotates the shaft 98 which rotates a further pinion 100 also fixed to the shaft 98.

A shaft 102 located parallel to the shaft 98 is appropriately mounted in bearing surfaces so as to be able to move backward and forward as is seen in FIG. 6 between its solid and phantom positions. The shaft 102 carries an elongated pinion 104 which is fixedly attached to it as well as a pinion 106 and spur gear 108 formed as a unit which are also fixedly attached to the shaft 102. Rotation of any of the gears 104, 106 or 108 results in rotation of the shaft 102 and rotation of the other of the gears.

The end of the arm 72 is positioned between the pinion 104 and the spur gear 108. As the arm 72 moves in conjunction with movement of the carrier member 52 about the pin 54, the end of the arm 72 engages one or the other of the gears 104 or 108 to slide them and the shaft 102 backward and forward as seen in FIG. 6.

When the shift lever 22 is in its neutral or center position, the elongated pinion 104 is positioned behind the pinion 102 and the spur gear 108 is positioned in front of it. The pinion 106 is positioned behind the spur gear 96. When the shift lever 22 is pushed forward into the low position, whether it be the forward direction or the reverse direction as explained above, the arm 72 engages the spur gear 108 and slides it and the shaft 102 and pinion 104 such that the pinion 106 engages the spur gear 96 to complete a drive train from the motor 26 to the shaft 102.

The elongated pinion 104 is always in engagement with a spur gear 110 which is fixed to an output shaft 112. Located on the respective ends of the output shaft 112 are output worms 114 and 116. When the shaft 102 is rotated because of the engagement of the pinion 106 with the spur gear 96, this ultimately transfers rotation to the output shaft 112 and the worms 114. The shaft 112 is rotated at a slow or low speed because of the step down from the spur gear 96 to the smaller pinion 106.

When the shift lever 22 is pulled backwardly to the high or fast position, the arm 72 is pushed against the pinion 104 to slide it and the shaft 102 and the gears 106 and 108 attached thereto. This engages the spur gear 108 against the pinion 100. This also completes a gear train from the motor 26 to the output shaft 112, but insofar as the spur gear 108 is larger than the pinion 100, the speed of the output shaft 112 is increased with respect to that described before for the low gear. This thus offers two output speeds of the the output shaft 112 for a constant speed of rotation of the motor 26.

As described above, the movement of the sliding member 32 causes reverse of the polarity of current output to the motor 26. This will reverse the direction of rotation of the pinion 88 such that when it rotates in a clockwise direction the output shaft 112 rotates in a first direction and when it rotates in a counterclockwise direction the output shaft 112 rotates in the opposite direction.

The worm 114 engages a pinion 118 which is mounted on a front axle 120 to drive the front wheels 18. In a like manner, the worm 116 engages a similar pinion, not numbered or shown, which attaches to the rear axle, not numbered or shown, which rotates the rear wheels 20. A clutch mechanism formed by a spring 122 and re-entrant gear 124 formed in part with the pinion 118 and in part with a bushing not separately numbered which fixedly attaches to the axle 120 prevents stripping of the gears or the like if the front or rear wheels are held while the motor 26 is engaged.

Both the front wheels 18 and the rear wheels 20 are connected to the chassis 12 by equivalent parts. Only those for the front wheels 18 are shown and described. The front axle 120 is encased with a casing 126 which is pivotably supported by a boss 128 which attaches to a tab 130 and by shaft 112 such that the axle can tilt. A spring 132 extends across the bottom part of the chassis 12 and if the casing 126 is pivoted to one direction it contacts the spring at one side and if it is pivoted to the other direction, it contacts the spring 132 at the other side. This allows rotation of the axles and the wheels attached thereto in a sort of independent suspension mechanism for the toy vehicle 10. The boss 128 is coaxially located with the shaft 112 about the center of rotation of the output shaft 112 such that as the case 126 pivots, the pinion 118 pivots around the worm gear 114 to allow movement of the axle 120 with respect to the chassis 12 while still maintaining transfer of rotation from the output shaft 112 to the axle 120 and ultimately to the front wheels 18. The same mechanism is provided for the rear wheels 20.

We claim:

1. A shift mechanism for a motorized toy which comprises:

a chassis housing;

a shift lever movably mounted on said housing so as to move back and forth along an X axis and a Y axis;

an electric motor fixedly mounted on said housing, said electric motor capable of producing a rotary output in both a clockwise and a counterclockwise direction;

an electric power supply connected to said electric motor to power said motor;

an elongated output shaft having ends, said elongated output shaft rotatably mounted in said chassis housing;

a mechanical linkage means connecting between said motor and said output shaft for transferring the output of said motor to said output shaft;

said mechanical linkage means connected to said elongated shaft intermediate its ends;

a transfer gear located at each of said ends of said shaft;

a first axle located proximal to one of the ends of said shaft, a second axle located proximal to the other of said ends of said shaft, each of said first and said second axles positioned perpendicular to said shaft, each of said axles including an axle gear located thereon, the transfer gear on one of said ends of said shaft mating with the axle gear on said first axle and the transfer gear on the other of the ends of said shaft mating with the axle gear on said second axle;

an electric linkage means operatively associated with said motor for controlling the direction of rotation of said electrical motor;

an X axis control means for transfer of motion of said shift lever about said X axis to said mechanical linkage means for controlling transfer of said output of said motor to said output shaft;

a Y axis control means for transferring motion of said shift lever about said Y axis to said electrical linkage means for controlling at least the direction of rotation of said motor.

2. The toy of claim 1 wherein:

said mechanical linkage means includes means for driving said output shaft at at least two speeds.

3. The toy of claim 2 wherein:

said mechanical linkage means includes gear train means.

4. The toy of claim 1 wherein:

said X axis comprises an axis parallel to the elongated dimension of said elongated output shaft;

said Y axis comprises an axis perpendicular to the elongated dimension of said elongated output shaft.

5. The toy of claim 4 wherein:

said electrical linkage means includes means for controlling power input to said electrical motor so as to control both the direction of rotation of said electrical motor and starting and stopping of said electrical motor.

6. The toy of claim 4 including:

clutch means for separating movement of said shift lever about the Y axis from movement about the X axis and movement about the X axis from movement about the Y axis.

7. The toy of claim 6 wherein:

said X axis control means includes a first clutch means for inhibiting the transfer of movement of said shift lever about the Y axis to said mechanical linkage means and a second clutch means for inhibiting the transfer of movement of said shift lever about the X axis to said electrical linkage means.

8. The toy of claim 4 wherein:

said electrical linkage means includes electrical switch means for reversing the polarity of said power supplied to said motor by said power supply and for completing and breaking a circuit between said power supply means and said electric motor.

9. The toy of claim 5 wherein:

clutch means for separating movement of said shift lever about the Y axis from movement about the X axis and movement about the X axis from movement about the Y axis.

10. The toy of claim 9 wherein:

said X axis control means includes a first clutch means for inhibiting the transfer of movement of said shift lever about the Y axis to said mechanical linkage means and a second clutch means for inhibiting the transfer of movement of said shift lever about the X axis to said electrical linkage means.

11. The toy of claim 10 wherein:

said electrical linkage means includes electrical switch means for reversing the polarity of said power supplied to said motor by said power supply and for completing and breaking a circuit between said power supply means and said electric motor.

12. The toy of claim 8 wherein:

clutch means for separating movement of said shift lever about the Y axis from movement about the X axis and movement about the X axis from movement about the Y axis.

13. The toy of claim 12 wherein:

said X axis control means includes a first clutch means for inhibiting the transfer of movement of said shift lever about the Y axis to said mechanical linkage means and a second clutch means for inhibiting the transfer of movement of said shift lever about the X axis to said electrical linkage means.

14. The toy of claim 3 wherein:

said electrical linkage means includes electrical switch means for reversing the polarity of said power supplied to said motor by said power supply and for completing and breaking a circuit between said power supply means and said electric motor.

15. The toy of claim 3 including:

clutch means for separating movement of said shift lever about the Y axis from movement about the X axis and movement about the X axis from movement about the Y axis.

16. The toy of claim 15 wherein:

said X axis control means includes a first clutch means for inhibiting the transfer of movement of said shift lever about the Y axis to said mechanical linkage means and a second clutch means for inhibiting the transfer of movement of said shift lever about the X axis to said electrical linkage means.

17. The toy of claim 1 including:

a first axle casing pivotally attaching to said housing, said first axle journaled in said first axle casing;

a second axle casing pivotally attaching to said housing, said second axle journaled in said second axle casing;

each of said first and second axle casings independently pivotally mounted with respect to said chassis housing so as to pivot in a direction perpendicular to the elongated axis of said elongated output shaft.

18. The toy of claim 17 wherein:

each of said transfer gears on said elongated output shaft comprise worm gears;

each of said axle gears on said first and said second axle comprises pinions, said pinions engaged with and rotated by said worm gears irrespective of said movement of said first and second casings with respect to said housing.

* * * * *